US008561348B2

(12) United States Patent
Kurth et al.

(10) Patent No.: US 8,561,348 B2
(45) Date of Patent: Oct. 22, 2013

(54) SECURITY AUTOMATIC GARAGE DOOR CLOSER

(76) Inventors: Steven Joseph Kurth, Phoenix, AZ (US); Joseph John Kurth, Highlands Ranch, CO (US)

( * ) Notice: Subject to any disclaimer, the term of this patent is extended or adjusted under 35 U.S.C. 154(b) by 0 days.

(21) Appl. No.: 13/410,433

(22) Filed: Mar. 2, 2012

(65) Prior Publication Data

US 2013/0227886 A1 Sep. 5, 2013

(51) Int. Cl.
*E05F 15/20* (2006.01)

(52) U.S. Cl.
USPC ..... 49/30; 49/199

(58) Field of Classification Search
USPC ..... 49/29, 30, 197, 199
See application file for complete search history.

(56) References Cited

U.S. PATENT DOCUMENTS

| | | | | | |
|---|---|---|---|---|---|
| 4,463,292 | A | | 7/1984 | Engelmann | |
| 5,247,232 | A | | 9/1993 | Lin | |
| 5,510,686 | A | * | 4/1996 | Collier | 318/446 |
| 5,752,343 | A | | 5/1998 | Quintus | |
| 5,864,134 | A | * | 1/1999 | Burgess | 250/221 |
| 6,046,562 | A | * | 4/2000 | Emil | 318/484 |
| 6,075,333 | A | * | 6/2000 | Huddle | 318/468 |
| 6,326,754 | B1 | * | 12/2001 | Mullet et al. | 318/480 |
| 6,437,527 | B1 | | 8/2002 | Rhodes et al. | |
| 6,469,464 | B1 | * | 10/2002 | McCall | 318/445 |
| 6,563,278 | B2 | | 5/2003 | Roman | |
| 6,819,071 | B2 | | 11/2004 | Graham et al. | |
| 6,989,760 | B2 | * | 1/2006 | Dierking et al. | 340/686.1 |
| 7,002,312 | B2 | * | 2/2006 | Wojciak, Jr. | 318/452 |
| 7,038,409 | B1 | * | 5/2006 | Mullet | 318/280 |
| 7,173,516 | B2 | * | 2/2007 | Mullet et al. | 340/5.71 |
| 7,315,143 | B2 | * | 1/2008 | Mullet et al. | 318/280 |
| 7,375,484 | B2 | * | 5/2008 | Murray | 318/466 |
| 7,688,014 | B2 | * | 3/2010 | Tang et al. | 318/466 |
| 2003/0174045 | A1 | | 9/2003 | Zhang | |
| 2004/0216379 | A1 | * | 11/2004 | Gioia et al. | 49/29 |
| 2005/0174250 | A1 | * | 8/2005 | Dierking et al. | 340/686.1 |
| 2005/0176400 | A1 | * | 8/2005 | Mullet et al. | 455/403 |
| 2005/0212681 | A1 | * | 9/2005 | Dzurko et al. | 340/632 |
| 2005/0218854 | A1 | * | 10/2005 | Gioia et al. | 318/599 |
| 2006/0012325 | A1 | * | 1/2006 | Robb et al. | 318/466 |
| 2006/0150511 | A1 | * | 7/2006 | Parsadayan | 49/29 |
| 2009/0282740 | A1 | * | 11/2009 | Nassimi | 49/28 |
| 2012/0188077 | A1 | * | 7/2012 | Sawyer | 340/540 |

OTHER PUBLICATIONS

Quintussentials, Inc, Garage Butler, web pages, 2009.

* cited by examiner

*Primary Examiner* — Jerry Redman
(74) *Attorney, Agent, or Firm* — Donald J Lenkszus

(57) ABSTRACT

A security kit is provided for automatic closing of a garage door after a predetermined time of garage door being open. The security kit comprises a replacement wall switch for operating the garage door operating mechanism. The replacement wall switch comprises a timer module and a sensor disposed to detect that the garage door is open or closed. The sensor is coupled to a timer input. The sensor and the timer cooperatively operate such that when the sensor detects that the garage door is closed, the timer is reset and disabled, and further cooperatively operate such that when the sensor detects that the garage door is open, the timer initiates timing a predetermined time period. The timer operates a switch at end of the predetermined time period to cause the garage door mechanism to close the garage door.

15 Claims, 4 Drawing Sheets

SECURITY AUTOMATIC GARAGE DOOR CLOSER

FIELD OF THE INVENTION

The present invention relates to a garage door system utilizing a reversible electrical motor for opening and closing the door, in general, and to an automatic garage door closer, in particular.

BACKGROUND OF THE INVENTION

Garage door openers typically utilize a reversible electric motor for opening and closing garage doors. In some installations, the garage door may be an overhead type garage door of the type where the door is carried on tracks. Typically overhead garage doors are segmented into panels, each panel having rollers that ride on the tracks.

Garage door openers typically include several safety features to prevent injury to persons or animals as the garage door is closed.

In typical installations, the garage door is operated by a wall-mounted switch and in addition may be operated by a wireless garage door opener. In some installations, the wall-mounted switch is an assembly that includes a separate switch to operate a light carried by the garage door opener.

A frequent problem that occurs is that the user of the garage door forgets to use the garage door opener to close the garage door after exiting the garage and starting to drive away. This creates a well-known security problem since the garage door may end up being open for extended periods of time until the garage occupant returns and parks in the garage again.

A need exists for a kit for use with existing garage installations that does not require any modification to the garage door opener and does not change or affect the various safety features of an existing garage door installation but will automatically close a garage door that has been inadvertently left open.

SUMMARY OF THE INVENTION

In accordance with principles of invention, a security kit is provided for automatic closing of a garage door after the garage door is open for a preselected predetermined time. The security kit may be used with a garage door installation comprising a reversible electric motor operable to open and close a garage door, a wall switch connected to the electric motor with a pair of conductors for operating the electric motor. The security kit replaces the existing wall switch.

In one embodiment, a security kit comprises a replacement wall switch for operating the electric motor. The replacement wall switch comprises: a housing, a first switch carried by the housing and connected to the pair of conductors, a timer disposed within the housing, a second switch disposed within the housing and connected in parallel with the first switch, the second switch is operable by the timer. The security kit further comprises a sensor disposed to detect that the garage door is open or closed. The sensor is coupled to a timer input. The sensor and the timer cooperatively operate such that when the sensor detects that the garage door is closed, the timer is reset and disabled, and further cooperatively operate such that when the sensor detects that the garage door is open, the timer initiates timing a predetermined time period. The timer operates the second switch at end of the predetermined time period.

In one embodiment, the replacement wall switch comprises a timer actuator coupled to the timer. The timer actuator is operable to enable and disable operation of the timer.

In one embodiment, the timer actuator comprises a time selector, that is operable to select the predetermined time period.

In an embodiment, the time selector may comprise a slide device carried on the housing. The slide device is slideable to select the predetermined time period.

The predetermined time period is selectable over a predetermined time range. The predetermined time range may extend from a minimum time period to a maximum time period.

In various embodiments, the sensor comprises a cam operable switch, the cam of the cam operable switch is in a first position when the garage door is closed and in a second position when the garage door is open.

In embodiments, the sensor is mountable proximate the garage door and the cam of said cam operable switch is disposed to be in a first position when the garage door is closed and in a second position when the garage door is not closed.

In the embodiments, the housing is wall mountable in place of the wall switch.

In various embodiments in which the wall switch to be replaced comprises a light switch operable to control a light carried by the garage door opener, the security kit, comprises a light switch carried by the housing to operate the light.

In various embodiments, the housing comprises a battery holder for holding one or more batteries to power the timer.

In yet additional embodiments, the sensor comprises a transmitter. The transmitter is operable to generate a first signal when the garage door is open. The housing comprises a receiver responsive to the first signal to initiate operation of the timer.

In certain embodiments, the sensor comprises a first battery holder connected to the transmitter for providing power to the transmitter. The certain embodiments may further comprise a second battery holder disposed in the housing for providing power to the receiver.

BRIEF DESCRIPTION OF THE DRAWING

The invention will be better understood from a reading of the following detailed description of various embodiments of the invention in conjunction with the attached drawing figures in which like reference designators are used to identify like elements, and in which the various elements are not drawn to scale and are intended to only be representative of the various elements and are not intended to provide any physical constraints to the invention, and in which.

DETAILED DESCRIPTION

Figure 1:
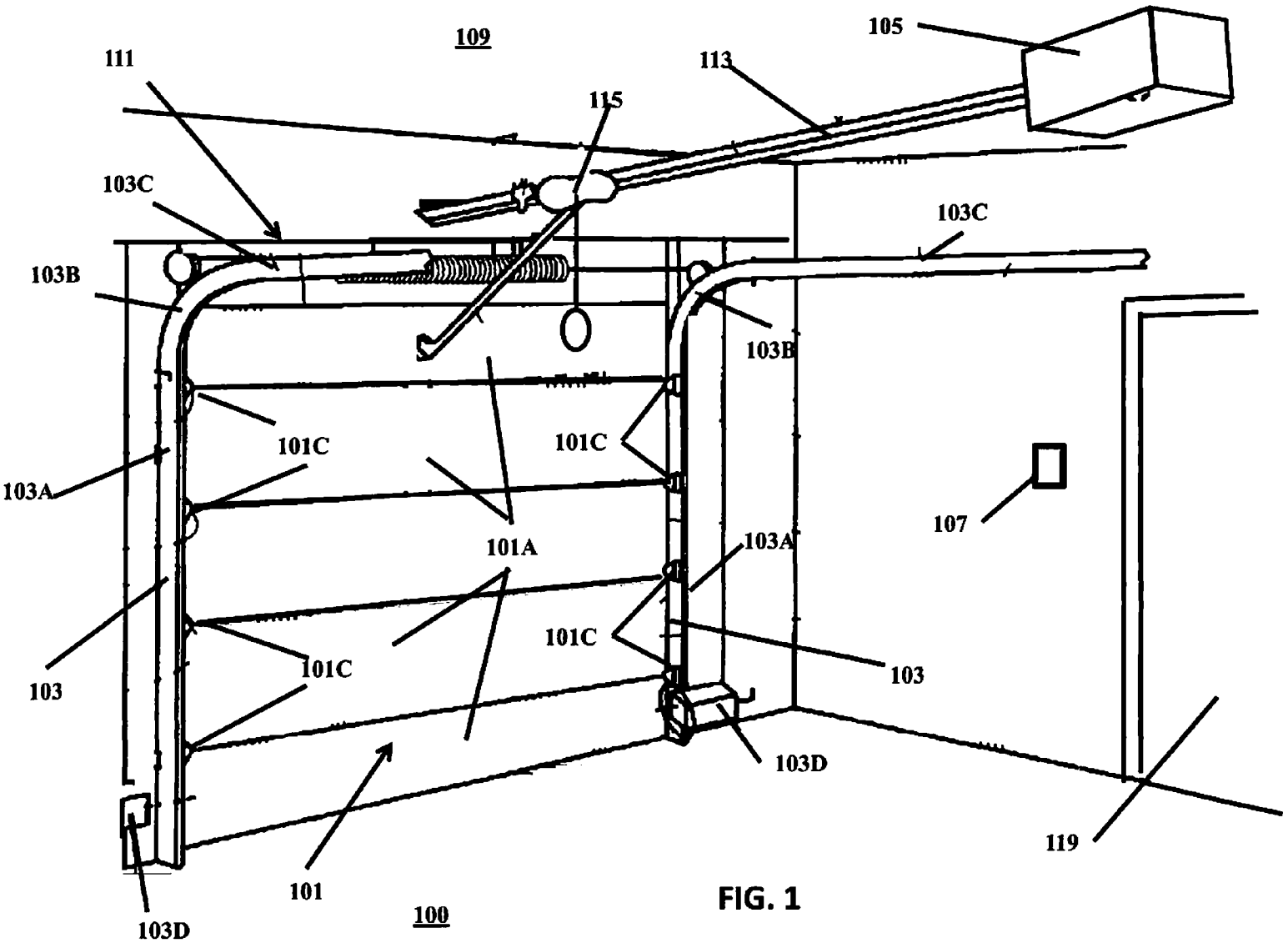
FIG. 1 illustrates a representative garage door installation to which the present invention is advantageously applied.

Turning now to FIG. 1, the interior of a garage 100 is shown. Garage 100 has an overhead garage door 101, comprising a plurality of door segments 101A that are joined together by hinges that are not shown. Each door segment 101A has one or more pairs of rollers 101C that are guided in tracks 103. Tracks 103 each include a generally vertical portion 103A and a generally horizontal portion 103C that are joined with a curved intermediate portion 103B A garage door opening mechanism 105 includes a reversible electric motor that either drives an elongated screw or a gear that is coupled to an endless chain in an overhead track 113. A bracket 125 is pivotally secured to the uppermost panel 101A of the garage door and is operationally connected to the screw or chain by a follower 115.

The garage door opening mechanism includes limit switches, that are not shown, that are adapted to de-energize the electric motor in garage door opening mechanism 105 at either end of garage door travel.

In alternate installations, garage door 101 could comprise a single panel of a size to close the opening of the garage 100, but without articulation, the door taking a different path of movement for opening and closing when actuated by the closer unit. Garage door structures are conventional and well known.

The garage door opening mechanism 105 includes a receiver, that is not shown. The receiver is mounted adjacent and operatively connected to the reversible electric motor in garage door opening mechanism 105. A transmitter, that is not shown, is carried by the operator or located in the vehicle of the garage owner provides a signal to the receiver to open or close the door.

A wall switch assembly 107 mounted on the garage door wall adjacent garage door 119 is connected to garage door mechanism 105 by wiring that is typically located in the wall and ceiling of garage 100. Wall switch assembly 107 includes a push button switch to actuate the motor contained in garage door opening mechanism 105. Wall switch assembly 107 may further include a light switch for operating a light that can be mounted on or is integral to garage door mechanism 105 or other suitable support in the ceiling of the garage.

The garage door opening mechanism 105 typically includes or is coupled to several safety features. One such safety feature may include photo sensors 103D mounted adjacent the lower ends of rails 103 to project a beam across the garage door opening which, when interrupted by an object as door 101 is closing, will reverse movement of door 101 to its open position.

In accordance with the principles of the invention, a security kit is provided for automatic closing of garage door 101 a predetermined time after the garage door is opened.

Figure 3:
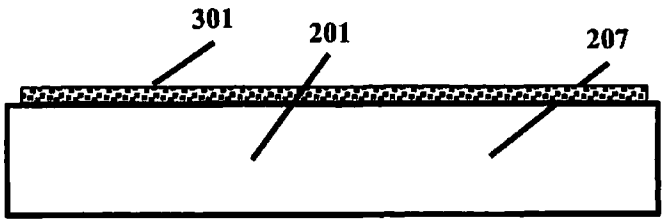
FIG. 3 is a top view of the assembly of FIG. 2.
Figure 2:
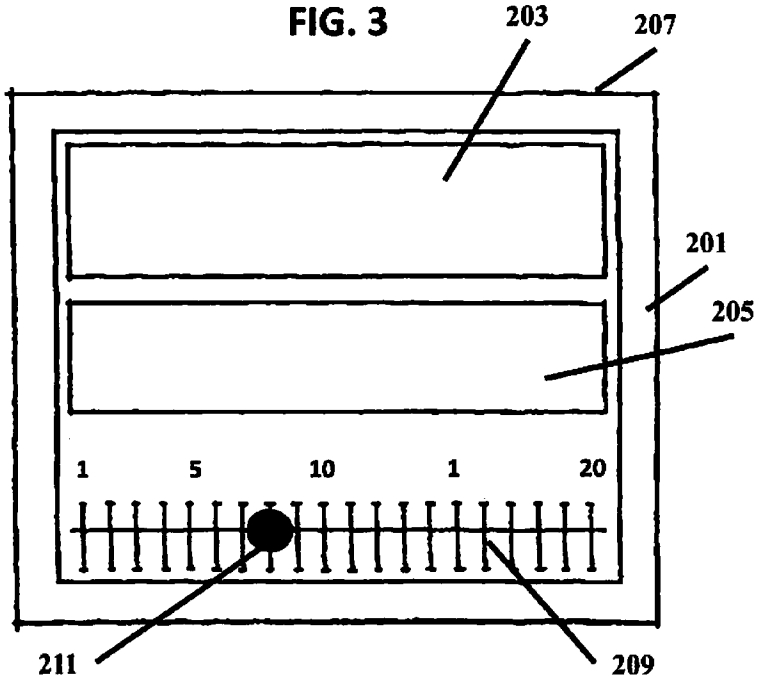
FIG. 2 is a front view of a replacement garage door switch assembly.
Figure 4:
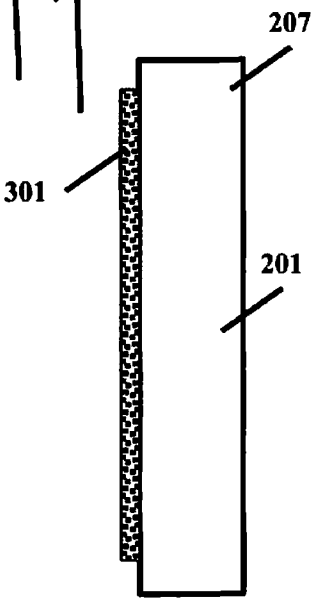
FIG. 4 is a side view of the assembly of FIG. 2.
Figure 5:
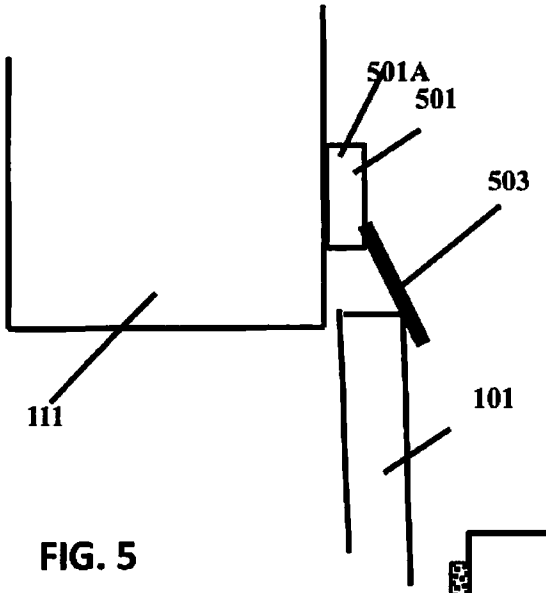
FIG. 5 is a side view of a switch assembly.

The security kit comprises a replacement wall switch assembly 207 shown in FIGS. 2, 3, and 4 and a door open sensor 501 shown in FIG. 5. Replacement wall switch assembly 207 replaces wall switch 107 in an existing garage door installation. Replacement wall switch 207 comprises a housing 201 which may be made of plastic or other material. FIGS. 3 and 4 show top and side views of housing 201, respectively. Housing 201 may be configured to surface mount on the garage wall in place of switch 107. Housing 201 may include an adhesive layer 301 on its back side to adhere to the garage wall surface or it may include a back plate that attaches to the garage wall with screws or other conventional fasteners. Housing 201 carries a first push button switch 205 used to operate the garage door and a second push button 203 used as a light switch for operating the garage door opener light.

In addition, replacement wall switch assembly 207 includes a timer control assembly 209. In the embodiment, the timer control assembly 209 includes a slide control 211 that is used to select a time period after which an open garage door will be automatically closed.

Door open sensor 501 shown in FIG. 5 comprises a switch sensor housing 501A that is mounted on the garage door header 111. Door open sensor 501 comprises a cam follower switch assembly that includes a lever or cam follower 503 that is in a first position when door 101 is closed and in a second position when door 101 is open.

Figure 6:
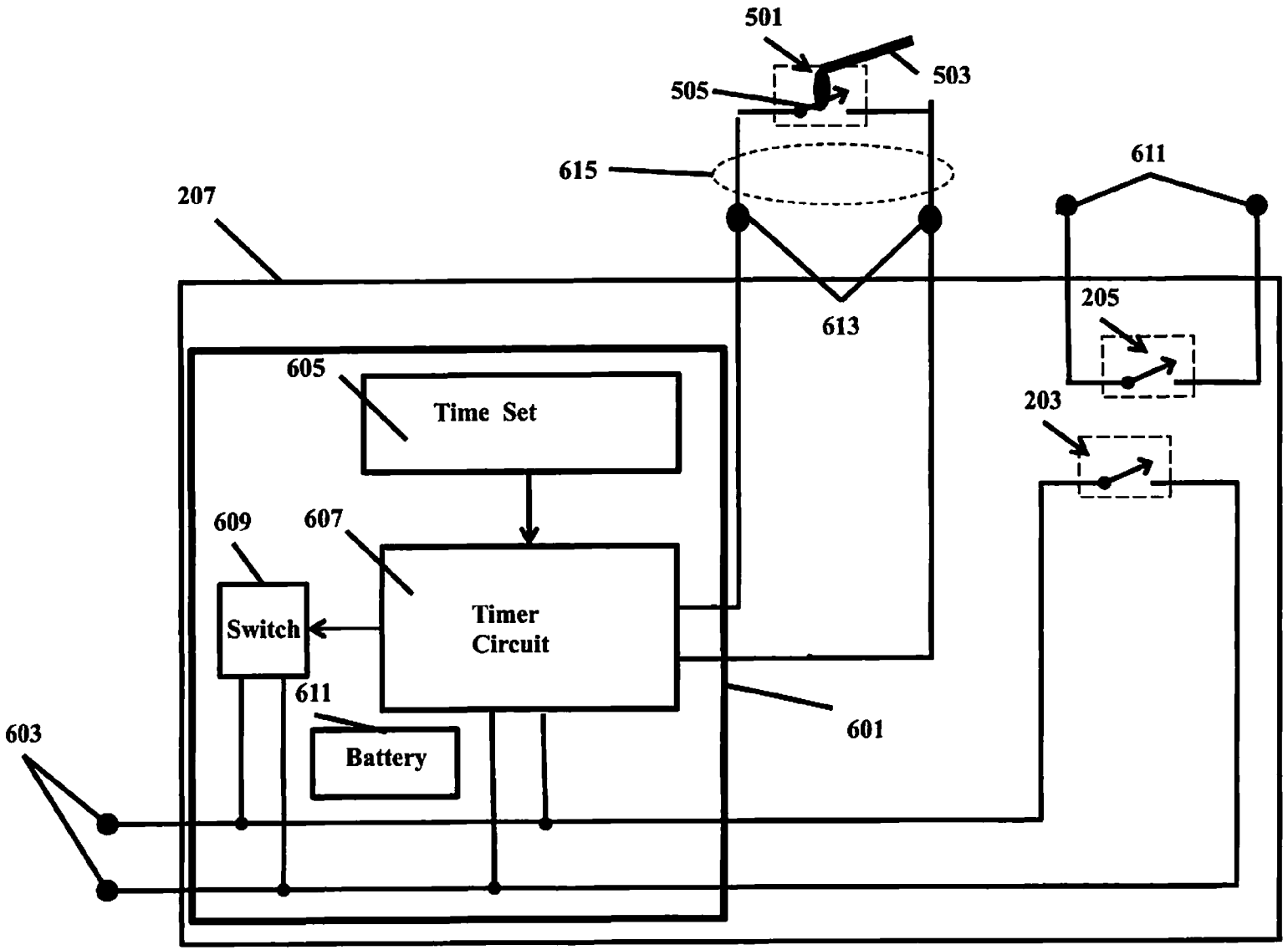
FIG. 6 is a block diagram of one embodiment.

Turning now to FIG. 6, lever or cam follower 503 is coupled to switch 505 and operates such that when door 101 is closed, switch 505 is in a first electrical state, e.g., electrically open, and when door 101 is open, switch 505 is in a second electrical state, e.g., electrically open.

In other embodiments, different sensor arrangements may be utilized to sense that garage door 101 is open or closed. One exemplary such sensor arrangement comprises a magnetically operated switch. In such an arrangement, a magnet may be mounted on the door adjacent the door frame, and a magnetically operated switch mounted on the door frame.

Replacement wall switch assembly 207 has a first set of terminals 603 that are connected to the existing wires that were connected to garage door wall switch assembly 101 to operate garage door 101. A second set of terminals 611 is connected to the existing wires for the garage door opener light. A third set of terminals 613 is provided for connection to wires 615 that are connected to door open sensor 501.

Replacement wall switch assembly 207 includes a timer module 601. Timer module 601 comprises a time select circuit 605, a timer circuit 607 coupled to the timer select circuit 605, an electrically controlled switch 609, and a power source or battery holder 611 holding one or more batteries.

Slide control 207 is coupled to time select circuit 605. When slide control 207 is in a first position, time select circuit 605 disables timer circuit 607. When timer circuit 607 is disabled, switch 607 is not operable. Switch 203 is a normally open, non-latching push button type switch. The contacts of switch 203 are connected to terminals 603. With timer circuit 607 disabled, switch 203 controls garage door opening mechanism 105 in the same manner that the original garage door switch 107 controls door opening mechanism 105.

When slide control 207 is moved to a position indicating a non-zero time, it controls time selector circuit 605. Time selector circuit 605 may be any one of a number of known time selection circuits. By way of non-limiting example, if timer circuit 607 operates such that a resistor value determines the timed operation of timer circuit 607, then time selector circuit 605 may be a linear potentiometer. Alternatively time selector circuit 605 may comprise a multiple position switch and series of resistors. In other embodiments, slide control 207 may be replaces with a rotary control. In further embodiments, slide control 207 may be replaced with a display and control pad. In yet further embodiments, slide control 207 may be replaced with a two-position switch, with one position for disabling timer circuit 607 and the other position being utilized to select a predetermined time period for timer circuit 607.

After slide control 207 is moved to select a predetermined time period, timer circuit 607 may be operated.

Switch 203 is coupled to timer circuit 607. Initially, with garage door 101 in a closed position, door open sensor 501 switch 505 is in a first state that inhibits timer circuit 607 from timing. In operation, when switch 203 is operated to open garage door 101, timer circuit 607 is enabled. As garage door 101 opens, door open sensor 501 switch 505 is moved into a second state to indicate that garage door 101 is in an open condition.

Timer circuit 607 operates such that when the preselected time delay occurs, timer circuit 607 operates switch 609. Switch 609 is connected in parallel with switch 203. Operating switch 609 will thereby cause door operating mechanism 105 to close garage door 101.

If prior to timer circuit 607 operating switch 609, switch 203 is operated, timer circuit 607 is reset.

Timer circuit 607 also operates such that whenever door open sensor 501 indicates that door 101 is open, timer circuit 607 begins timing. Upon expiration of the preselected time delay, timer 607 operates switch 609 to cause door operating mechanism 105 to close door 101.

Figure 7:
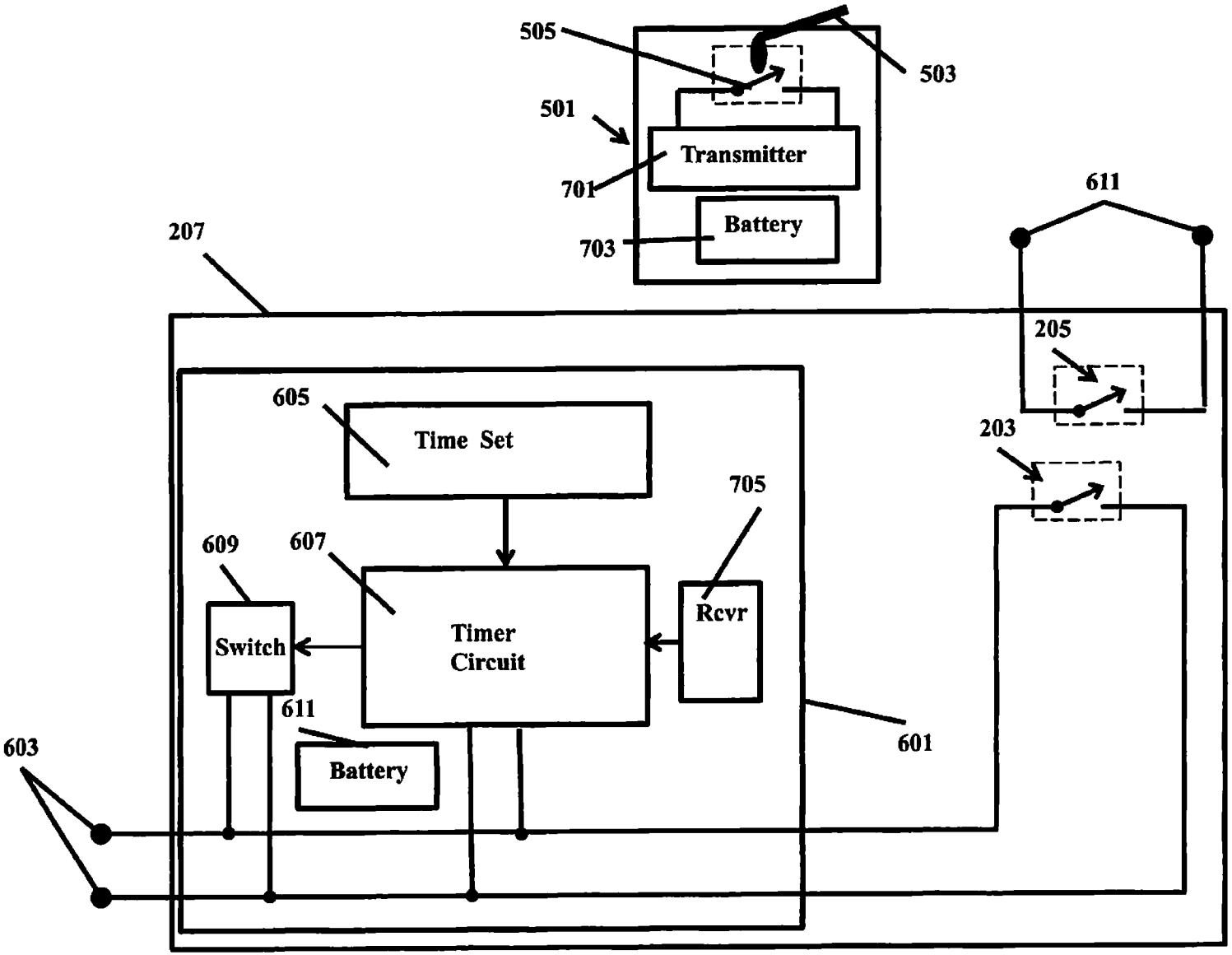
FIG. 7 is block diagram of a second embodiment.

Turning now to FIG. 7, another embodiment is shown. In the embodiment of FIG. 7, wiring 615 is replaced with a wireless transmitter 701 and a battery holder 703 holding one or more batteries at door opening sensor 501 and a receiver 705 in timer module 601. The operation of the embodiment of FIG. 7 is the same as the operation of the embodiment of FIG. 6 except that the state of door sensor 501 switch 505 is transmitted by transmitter 701 to receiver 705.

The invention has been described in terms of illustrative embodiments. It will be apparent to those skilled in the art that various changes and modifications can be made to the illustrative embodiments without departing from the spirit or scope of the invention. It is intended that the invention include all such changes and modifications. It is also intended that the invention not be limited to the illustrative embodiments shown and described. It is intended that the invention be limited only by the claims appended hereto.

What is claimed is:

1. A security kit for a garage door operator comprising a reversible electric motor operable to open and close a garage door along a path, a wall switch connected to said electric motor with a pair of conductors for operating said electric motor, and safety apparatus for preventing said garage door from closing on an obstruction in the path of said garage door when said garage door is closing, said security kit comprising:

a replacement wall switch for operating said electric motor, said replacement wall switch comprising: a housing, a first normally open switch carried by said housing and connected to said pair of conductors; a timer disposed within said housing; a second switch disposed within said housing and connected in parallel with said first switch, said second switch being operable by said timer to provide a momentary closure between said pair of conductors, said timer comprising a timer input;

a sensor disposed to detect that said garage door is open or closed, said sensor coupled to said timer input;

said sensor and said timer cooperatively operable such that when said sensor detects that said garage door is closed, said timer is reset and disabled, and operable such that when said sensor detects that said garage door is open, said timer initiates timing a predetermined time period, said timer operating said second switch at the end of said predetermined time period; and said sensor comprises a transmitter, said transmitter being operable to generate a door open signal when said garage door is open; and said housing comprising a receiver responsive to said door open signal to initiate operation of said timer.

2. A security kit in accordance with claim 1, wherein:

said replacement wall switch comprises a timer actuator coupled to said timer, said timer actuator operable to enable and disable operation of said timer.

3. A security kit in accordance with claim 1, comprising:

a time selector operable to select said predetermined time period.

4. A security kit in accordance with claim 3, wherein:

said time selector comprises a slide device carried on said housing, said slide device is slideable to select said predetermined time period.

5. A security kit in accordance with claim 3, wherein:

said predetermined time period is selectable over a predetermined time range.

6. A security kit in accordance with claim 5, wherein:

said predetermined time range extends from a minimum time period to a maximum time period.

7. A security kit in accordance with claim 1, wherein:

said sensor comprises a cam operable switch, said cam being in a first position when said garage door is closed and in a second position when said garage door is open.

8. A security kit in accordance with claim 1, wherein:

said sensor comprises at least a portion in direct engagement with said garage door when said garage door is in a closed position.

9. A security kit in accordance with claim 1, wherein:

said housing is wall mountable in place of said wall switch.

10. A security kit in accordance with claim 1, wherein said wall switch comprises a light switch operable to control a light carried by said garage door opener, said security kit, comprising:

a light switch carried by said housing to operate said light.

11. A security kit in accordance with claim 1, wherein:

said housing comprises a battery holder for holding one or more batteries to power said timer.

12. A security kit in accordance with claim 1, comprising:

a first battery holder connected to said transmitter for providing power to said transmitter.

13. A security kit in accordance with claim 12, comprising:

a second battery holder disposed in said housing for providing power to said receiver.

14. A security kit for a garage door operator comprising a reversible electric motor operable to open and close a garage door along a path, a wall switch connected to said electric motor with a pair of conductors for operating said electric motor, and safety apparatus for preventing said garage door from closing on an obstruction in the path of said garage door when said garage door is closing, said security kit comprising:

a replacement wall switch for operating said electric motor, said replacement wall switch comprising: a housing, a first normally open switch carried by said housing and connected to said pair of conductors; a timer disposed within said housing, said timer comprising a timer actuator operable to enable and disable operation of said timer; a second switch disposed within said housing and connected in parallel with said first switch, said second switch being operable by said timer to provide a momentary closure between said pair of conductors, said timer comprising a timer input;

a sensor disposed to detect that said garage door is open or closed, said sensor coupled to said timer input;

said sensor and said timer cooperatively operable such that when said sensor detects that said garage door is closed, said timer is reset and disabled, and operable such that when said sensor detects that said garage door is open, said timer initiates timing a predetermined time period, said timer operating said second switch at the end of said predetermined time period; and said sensor comprises a battery holder for holding one or more batteries, said sensor coupling said one or more batteries in said battery holder to said timer when said garage door is open and disconnecting said one or more batteries from said timer when said garage door is closed.

15. A security kit for a garage door operator comprising a reversible electric motor operable to open and close a garage door along a path, a wall switch connected to said electric motor with a pair of conductors for operating said electric motor, and safety apparatus for preventing said garage door from closing on an obstruction in the path of said garage door when said garage door is closing, said security kit comprising:

a replacement wall switch for operating said electric motor, said replacement wall switch comprising: a housing, a first normally open switch carried by said housing and connected to said pair of conductors; a timer disposed within said housing, said timer comprising a timer actuator operable to enable and disable operation of said timer; a second switch disposed within said housing and connected in parallel with said first switch, said second switch being operable by said timer to provide a momentary closure between said pair of conductors, said timer comprising a timer input;

a sensor disposed to detect that said garage door is open or closed, said sensor coupled to said timer input;

said sensor and said timer cooperatively operable such that when said sensor detects that said garage door is closed, said timer is reset and disabled, and operable such that when said sensor detects that said garage door is open, said timer initiates timing a predetermined time period, said timer operating said second switch at the end of said predetermined time period; and said sensor coupled to a power source, said sensor coupling said power source to said timer when said garage door is open and disconnecting said power source from said timer when said garage door is closed.

* * * * *